US006718995B2

(12) United States Patent
Dotterweich

(10) Patent No.: US 6,718,995 B2
(45) Date of Patent: Apr. 13, 2004

(54) AWNING FOR COLLAPSIBLE SHELTER

(76) Inventor: Martin J. Dotterweich, 502 Rancho La Mirada La., Escondido, CA (US) 92025

( * ) Notice: Subject to any disclaimer, the term of this patent is extended or adjusted under 35 U.S.C. 154(b) by 55 days.

(21) Appl. No.: 10/242,492

(22) Filed: Sep. 12, 2002

(65) Prior Publication Data

US 2004/0050412 A1 Mar. 18, 2004

(51) Int. Cl.[7] ..... E06B 9/00
(52) U.S. Cl. ..... 135/131; 135/117
(58) Field of Search ..... 135/87, 121, 124, 135/128, 130, 131, 135, 139, 141, 143, 144, 145, 117, 120.1; 160/45, 50, 65

(56) References Cited

U.S. PATENT DOCUMENTS

| | | | | |
|---|---|---|---|---|
| 1,607,020 A | * | 11/1926 | Stoll | 135/117 |
| 1,846,011 A | * | 2/1932 | Adams | 135/158 |
| 2,151,908 A | | 3/1939 | Gottlier | |
| 3,182,672 A | | 5/1965 | Biller, Jr. | |
| 3,621,857 A | | 11/1971 | May et al. | |
| 3,744,195 A | | 7/1973 | Ferkich | |
| 3,893,466 A | | 7/1975 | Barker | |
| 4,433,699 A | | 2/1984 | Schultes et al. | |
| 4,813,442 A | | 3/1989 | Haines | |
| 5,035,253 A | | 7/1991 | Bortles | |
| 6,273,172 B1 | | 8/2001 | Frey | |

FOREIGN PATENT DOCUMENTS

| | | | |
|---|---|---|---|
| IT | 612929 | * 11/1960 | 135/117 |

* cited by examiner

*Primary Examiner*—James O. Hansen
(74) *Attorney, Agent, or Firm*—Calif Tervo

(57) ABSTRACT

A collapsible awning (50) for a collapsible shelter (10) including canopy (15) supported by collapsible structure (20) including truss network (40) and legs (21). Collapsible awning (50) includes awning (90) supported by collapsible awning support (51). Awning support (51) includes a pair of side supports (52), each attached to a leg (21) of structure (20). Each side support (52) includes an arm (61) having a proximal end (62) pivotly attached to upper end (23) of leg (21) and a distal end (64) a strut (71) having outer end (74) pivotly attached to arm (61) and inner end (72) pivotly attached to slider (76) that slides up leg (21) to move side support (52) from a collapsed position to an erect position, wherein arm (61) is pivoted outward from leg (21). Awning (90) is attached to and snaps between arms (71).

20 Claims, 2 Drawing Sheets

FIG. 1
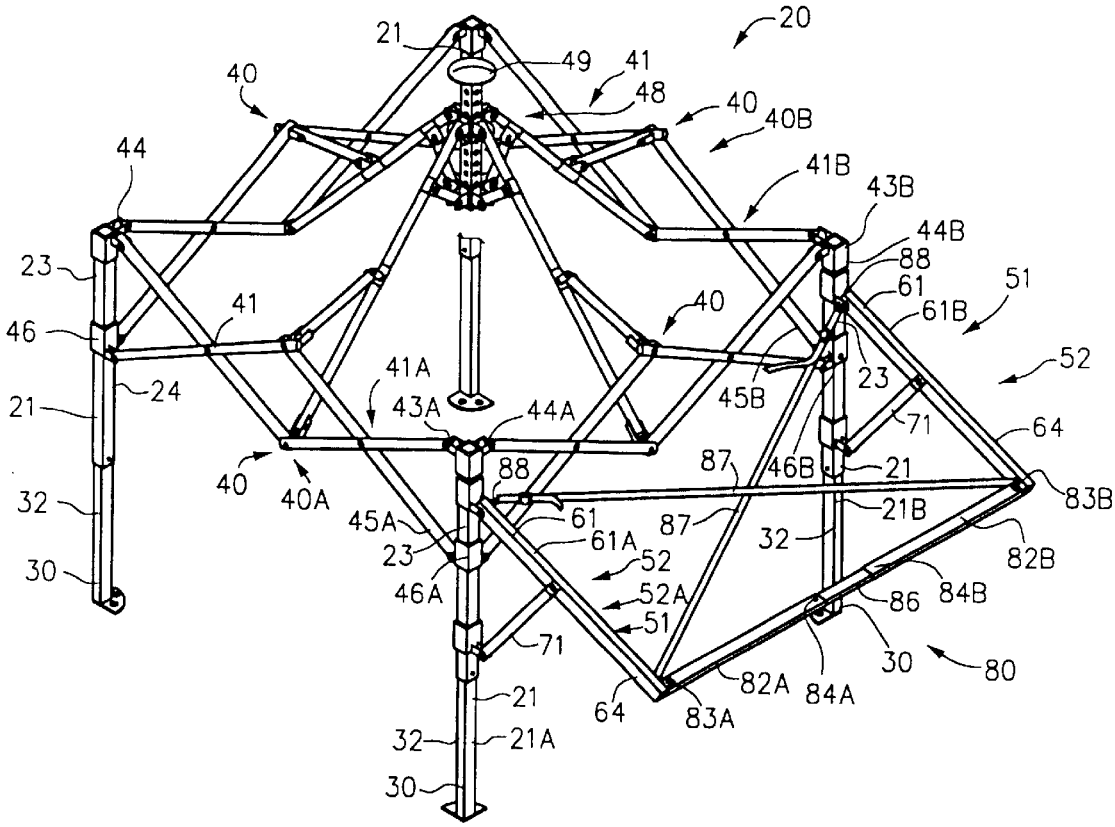
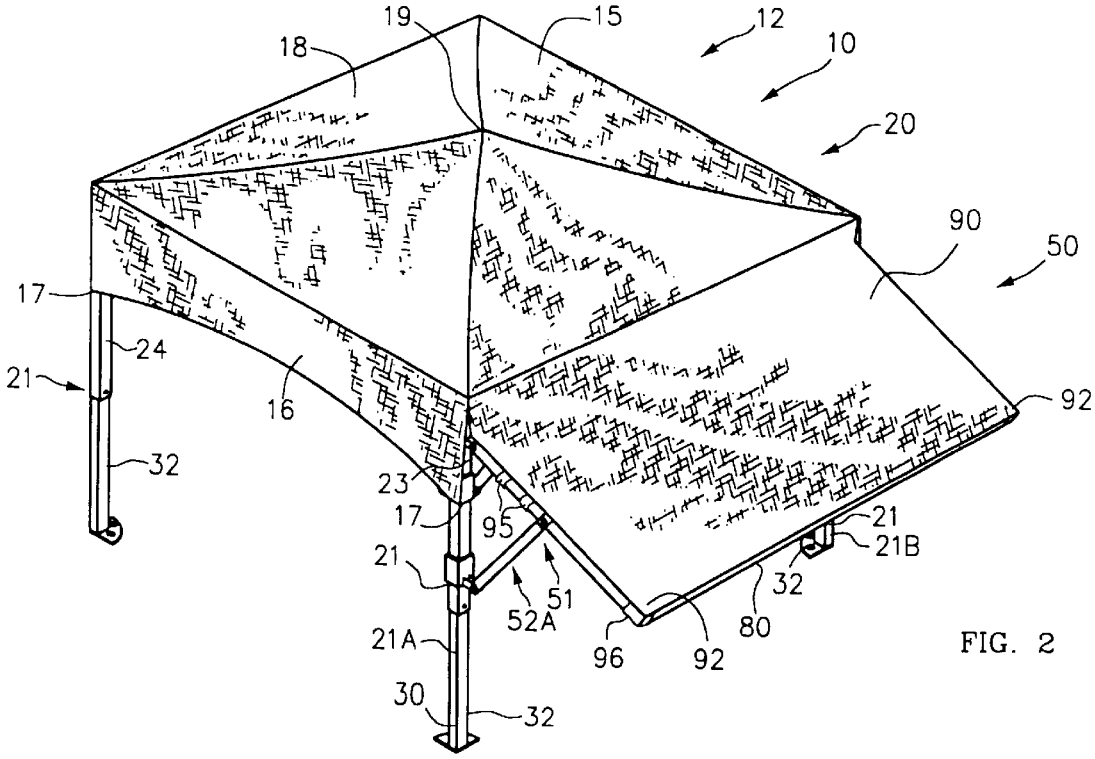
FIG. 2

FIG. 3
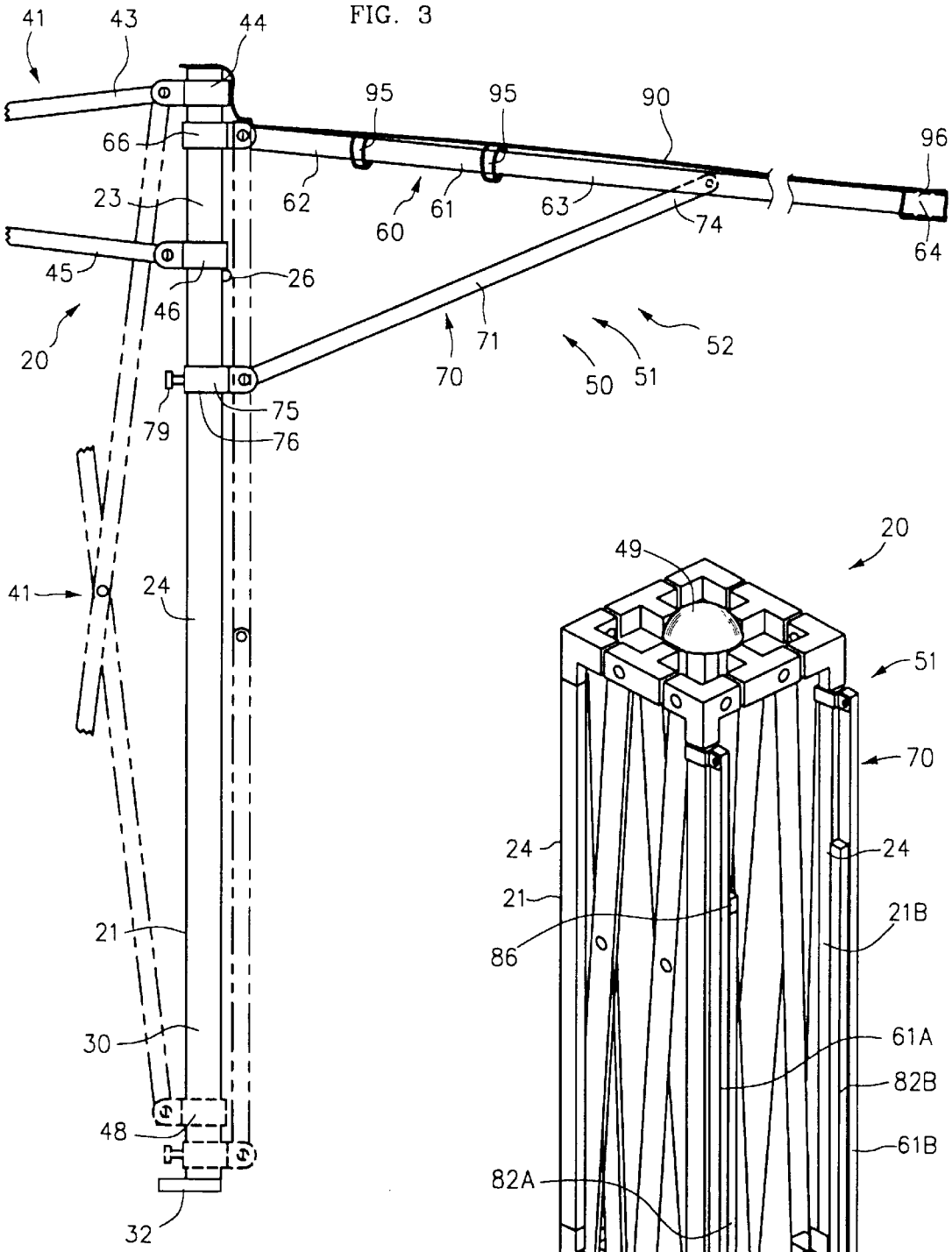
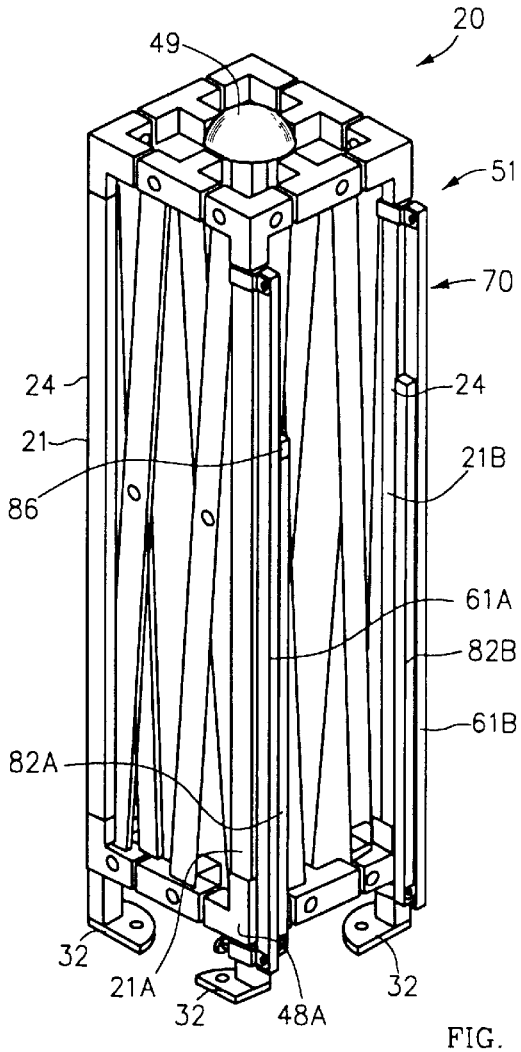
FIG. 4

AWNING FOR COLLAPSIBLE SHELTER

FIELD OF THE INVENTION

This invention relates in general to collapsible shelters, and more specifically involves a collapsible awning, for use with a collapsible shelter.

BACKGROUND OF THE INVENTION

Portable, free-standing, collapsible shelters having a support structure supporting a canopy are well-known and are often used at fairs, exhibits, and outdoor social functions. The collapsed shelter is easily transported and stored.

It would be desirable to increase the protected area of a collapsible shelter without significant increasing size, weight, or cost of materials.

SUMMARY OF THE INVENTION

The invention is a collapsible awning for a collapsible shelter. The shelter generally includes a canopy supported by a collapsible structure, including a truss network and legs. The collapsible awning includes an awning supported by an awning support movable from a collapsed position to an erect position. The awning support includes a pair of side supports, each attached to a leg of the structure. Each side support includes an arm and a strut. The arm has a proximal end pivotly attached to the upper end of its leg such that the arm is pivotable from a collapsed position, wherein the arm hangs down next to the leg, to an erect position, wherein the arm's distal end is pivoted upward and outward from the leg.

The strut has an outer end pivotly attached to the arm and an inner end pivotly attached to a slider on the leg. The slider slides up the leg from a lower position, wherein the side support is in a collapsed position, wherein the longitudinal axes of arm and strut are substantially parallel with the longitudinal axis of the first leg, to a higher position wherein the side support is in an erect position, wherein strut supports arm pivoted outward from the first leg. Preferably, the arm and strut are nested when in the collapsed position. The awning is attached to and spans between the arms.

Other features and many attendant advantages of the invention will become more apparent upon a reading of the following detailed description together with the drawings wherein like reference numerals refer to like parts throughout.

BRIEF DESCRIPTION OF THE DRAWINGS

FIG. 1 is a perspective view of a collapsible shelter including collapsible awning shown in the erect position.

FIG. 2 is a perspective view of the erect collapsible canopy support and awning support of FIG. 1 without canopy or awning cover.

FIG. 3 is an enlarged partial side elevation view of the canopy support and awning support as attached to a leg in the erect position and, in phantom, in a collapsed position.

FIG. 4 is a perspective view of the canopy support and awning support in the collapsed position.

DETAILED DESCRIPTION OF THE INVENTION

FIG. 1 is a perspective view of a collapsible shelter 10 including canopy section 12 including supported canopy 15 and awning section 50 including supported awning 90, both shown in the erect position FIG. 2 is perspective view of the erect collapsible canopy support 20 and awning support 51 of FIG. 1 without canopy 15 or awning cover 90. FIG. 3 is an enlarged partial side elevation view of canopy support 20 and awning support 51 in the erect position and, in phantom, in a collapsed position as attached to a leg 21.

Canopy support 20 is of a nature that is well known in the art and generally includes three or more support legs 21 and side structures 40 joining legs 21. Each leg 21 has a longitudinal axis, an upper end 23, and a lower end 30. Legs 21 include a first leg 21A and second leg 21B. Legs 21 are telescopic and include an upper outer member 24 and a lower inner member 32 movable from an erect position shown in FIGS. 1 and 2 to a collapsed position as shown in FIGS. 3 and 4.

Side structures 40 generally include one or more X-configured truss structures 41 and truss sliding members 46 on legs 21. First side structure 40A includes a first truss sliding member 46A slidingly attached to first leg 21A and a first X-configured truss structure 41A including a first upper end 43A pivotly attached, such as by first pivot bracket 44A to upper end 23 of first leg 21A, and a first lower end 45A pivotly attached to first truss sliding member 46A. Second side structure 40B includes a second truss sliding member 46B slidingly attached to second leg 21B and a second X-configured truss structure 41B including a second upper end 43B pivotly attached, such as by second pivot bracket 44B to upper end 23 of second leg 21B, and a second lower end 45B pivotly attached to second truss sliding member 46B. Truss sliding members 46 are supported in the higher or erect position by any suitable means well known in the art, such as abutment button 26. Center structure 48 supports center post 49 and adds rigidity to canopy support 20.

Canopy 15, supported by canopy support 20, includes a periphery 16 attached to support 20 by suitable means, such as hook/loop fastener straps 17, and a roof 18 having an apex 19 over center post 19. Canopy 15 may be made of any suitable material for providing sun or rain protection.

Awning support 51 comprises a pair of side supports 52 including first and second side supports 52A, 52B attached to first and second legs 21A, 21B respectively.

Returning to FIG. 3, an awning side support 52 is shown attached to leg 21. Side support 52 generally includes an arm assembly 60 and a strut assembly 70. Arm assembly 60 includes an arm 61 having a longitudinal axis and including a proximal end 62, a distal end 64; and a midsection 63 therebetween. Pivot mount 66 is mounted on upper end 23 of leg 21 and pivotly attaches proximal end 62 of arm 61 to upper end 23 of leg 21 such that arm 61 is pivotal from a collapsed position, shown in phantom, wherein the longitudinal axis of arm 61 substantially parallels the longitudinal axis of leg 21, to the erect position shown, wherein arm 61 is pivoted outward and upward from leg 21.

In the preferred embodiment shown, distal ends 64 of arms 61 are joined in the erect position, by means, such as by a front bar 80, maintaining ends 64 at a fixed distance. Front bar 80 includes a first section 82A having a first end 83A pivotly connected to distal end 64 of first arm 61A and a distal end 84A, and a second section 82B having a first end 83B pivotly connected to distal end 64 of second arm 61B and a distal end 84B. Distal ends 84A, 84B include means, such as telescoping section 86, for selectively joining them in the erect position to form a rigid member and for releasing them for folding into the collapsed position of FIG. 4. Telescoping section 86 is connected and collapsed by detent buttons as is well known in the art. First ends 83A, 83B are pivotly connected to fold up next to arms 61A, 61B in the collapsed position.

A pair of truss members such as flexible tension members, such as straps 87, connect the proximal end; 62 of each arm 61 (or the adjacent leg structure) to the distal end 64 of the other arm 61. Straps 87 include means, such as buckles 88, for adjusting the tension therein. Straps 87 and front bar 80 contribute greatly to the strength and rigidity of awning section 50.

Strut assembly 70 includes a strut 71 and attachment means 75. Strut 71 has a longitudinal axis and includes a first end, such as outer end 74 pivotly attached to arm 61, and a second end, such as inner end 72. Attachment means 75, such as first strut slider 76, is slidingly attached to leg 21 and slidingly and pivotly attaches inner end 72 of strut 71 to leg 21 and is slideable along leg 21 from a lower position, wherein said side support 52 is in a collapsed position, wherein the longitudinal axes of arm 61 and strut 71 are substantially parallel with the longitudinal axis of leg 21, to a higher position, wherein side support 52 is in an erect position, wherein strut 71 supports arm 61 pivoted outward and upward from leg 21. Slider 76 includes retaining means, such as set screw 79, or any other well known such means, such as an abutment button, for retaining first strut slider 76 at the higher position. This describes a preferred embodiment of side support 52. Preferably, arm 61 and strut 71 nest one inside the other, as shown, so as to collapse into a more compact space. Therefore, at least one is typically a channel. Upon a reading of this disclosure, other configurations of side support 52 will become apparent to those skilled in the art and it is intended to cover in the attached claims such configurations as come within the spirit and scope of the invention.

As best seen in FIGS. 1 and 2, awning 90 includes sides 92 attached by any suitable means, such as hook/loop fasteners 95 or end pockets 96, to first arm 61A of first side support 52A and second arm 62B of second side support 52B so as be suspended therebetween. With the remainder of shelter 10 in the erect position, awning 90 can be moved to the collapsed position to cover the wall area between first and second legs 21A, 21B for privacy or keeping out wind. In the erect position, awning 90 significantly increases the protected area of shelter 10.

FIG. 4 is a perspective view of canopy support 20 and awning support 51 in the collapsed position. Canopy support structure 20 is collapsible from an erect position, wherein legs 21 are erect and spaced so as to define a shelter area adapted for supporting canopy 15, to this collapsed position, wherein legs 21 are in close proximity. In the collapsed position, shelter 10 may be easily transported or stored.

From the foregoing description, it is seen that the present invention provides an extremely simple, efficient, and reliable manner of greatly increasing the area of a collapsible shelter without significant increase in the size, weight or cost of materials. Generally, a plurality of collapsible awnings could be mounted on the legs of a shelter.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A collapsible awning for a collapsible shelter, the shelter including a canopy supported by a collapsible truss network and at least three support legs including a first leg having a longitudinal axis and including: an upper end; and a lower end; and a second leg having a longitudinal axis and including: an upper end; and a lower end; said collapsible awning comprising:

an awning support movable from a collapsed position to an erect position; said awning support including:

a first side support including:

a first arm having a longitudinal axis including:

a proximal end, a distal end; and a midsection therebetween;

pivot attachment means for pivotly attaching said proximal end to the upper end of the first leg such that said first arm is pivotal from a collapsed position, wherein the longitudinal axis of said first arm parallels the longitudinal axis of the first leg, to an erect position, wherein said first arm is pivoted outward from the first leg; and a first strut having a longitudinal axis and including:

an outer end pivotly attached to said first arm; and an inner end; and a first strut slider slidingly and pivotly attaching said inner end of said first strut to the first leg and slideable along the first leg from a lower position, wherein said first side support is in a collapsed position, wherein the longitudinal axes of said first arm and said first strut are substantially parallel with the longitudinal axis of the first leg, to a higher position wherein said first side support is in an erect position, wherein first strut supports said first arm pivoted outward from the first leg; and a second side support including:

a second arm having a longitudinal axis including:

a proximal end;

a distal end; and a midsection therebetween;

pivot attachment means for pivotly attaching said proximal end to the upper end of the second leg such that said second arm is pivotal from a collapsed position, wherein the longitudinal axis of said second arm parallels the longitudinal axis of the second leg, to a erect position, wherein said second arm is pivoted outward from the second leg; and a second strut having a longitudinal axis and including:

an outer end pivotly attached to said second arm; and an inner end; and a second strut slider slidingly and pivotly attaching said inner end of said second strut to the second leg and slideable along the second leg from a lower position, wherein said second side support is in a collapsed position, wherein the longitudinal axes of said second arm and said second strut are substantially parallel with the longitudinal axis of the second leg, to a higher position, wherein said second side is in an erect position, wherein second strut supports said second arm pivoted outward from the second leg; and an awning including:

a first side attached to said first arm; and a second side attached to said second arm.

2. The collapsible awning of claim 1 wherein:

said first strut slider includes:

retaining means for retaining said first strut slider at the higher position; and said strut second slider includes:

retaining means for retaining said second strut slider at the higher position.

3. The collapsible awning of claim 1 wherein:

said first arm and said first strut are nested when in the collapsed position; and said second arm and said second strut are nested when in the collapsed position.

4. The collapsible awning of claim 1 wherein the collapsible truss network of the shelter includes: a first side structure including: a first truss sliding member slidingly attached to the first leg, and a first X-configured truss structure including: an upper end pivotly attached to the upper end of the first leg; and a lower end pivotly attached to the truss sliding member; and a second side structure including: a second truss sliding member slidingly attached to the second leg, and a second X-configured truss structure including: an upper end pivotly attached to the upper end of the second leg; and a lower end pivotly attached to the second thus sliding; and wherein:

said first strut slider is below the first truss slider; and said second strut slider is below the second truss slider.

5. The collapsible awning of claim 1 wherein said awning support includes:

a front bar connecting said distal ends of said first and second arms; said front bar having an erect position maintaining said distal ends if said first and second arms at a fixed distance, and a collapsed position.

6. The collapsible awning of claim 1 wherein said awning support includes:

a pair of truss members connecting said proximal end of each said arm to said distal end of the other said arm.

7. A collapsible awning for a collapsible shelter; the shelter including a canopy supported by a collapsible truss network and at least three support legs including a first leg having a longitudinal axis and including an upper end; and a lower end; and a second leg having a longitudinal axis and including; an upper end; and a lower end; the collapsible truss network joining the legs and movable from an erect position, wherein the legs are erect and spaced so as to define a shelter area adapted for supporting the canopy, to a collapsed position, wherein said legs are in-close proximity; said collapsible awning comprising:

an awning support movable from a collapsed position to an erect position; said awning support including:

a first side support including:

a first arm having a longitudinal axis including:

a proximal end;

a distal end; and a midsection therebetween;

pivot attachment means for pivotly attaching said proximal end to the upper end of the first leg, such that said first arm is pivotal from a collapsed position, wherein the longitudinal axis of said first arm parallels the longitudinal axis of the first leg, to an erect position, wherein said first arm is pivoted outward from the first leg; and a first strut having a longitudinal axis and including:

a first end pivotly attached to the first leg or said first arm; and a second end including:

first attachment means; said first strut pivotable from a collapsed position, wherein its longitudinal axis is substantially parallel with the longitudinal axis of said the leg, to an erect position, wherein said attachment means attaches said second end to the other of the first leg or said first arm, such that said first strut spans between said first leg and said first arm and supports said first arm in the erect position; and a second side support including:

a second arm having a longitudinal axis including:

a proximal end;

a distal end; and a midsection therebetween;

pivot attachment means for pivotly attaching said proximal end to the upper end of the second such that said second arm is pivotal from a collapsed position, wherein the longitudinal axis of said second arm parallels the longitudinal axis of the second leg, to an erect position, wherein said second arm is pivoted outward from the second leg; and a second strut having a longitudinal axis and including:

a first end pivotly attached to the second leg or said second arm; and a second end including:

second attachment means; said second strut pivotable from a collapsed position, wherein its longitudinal axis is substantially parallel with the longitudinal axis of said the leg, to an erect position wherein said attachment means attaches said second end to the other of the second leg or said second arm, such that said second strut spans between said second leg and said second arm and supports said second arm in the erect position; and an awning including:

a first side attached to said first arm; and a second side attached to said second arm.

8. The collapsible awning of claim 7 wherein:

said first strut first end is pivotly attached to said first arm; and said first attachment means includes:

a first strut slider slidingly and pivotly attaching said second end of said first strut to the first leg and slideable along the first leg from a lower position, wherein said first side support is in a collapsed position, wherein the longitudinal axes of said first arm and said first strut are substantially parallel with the longitudinal axis of the first leg, to a higher position, wherein said first side support is in an erect position, wherein first strut supports said first arm pivoted outward from the first leg; and said second strut first end is pivotly attached to said second arm and said second attachment means includes:

a second strut slider slidingly and pivotly attaching said second end of said second strut to the second leg and slideable along the second leg from a lower position, wherein said second side support is in a collapsed position, wherein the longitudinal axes of said second arm and said second strut are substantially parallel with the longitudinal axis of the second leg, to a higher position, wherein said second side is in an erect position, wherein second strut supports said second arm pivoted outward from the second leg.

9. The collapsible awning of claim 8 wherein:

said first strut slider includes:

retaining means for retaining said first strut slider at the higher position; and said second strut slider includes:

retaining means for retaining said second strut slider at the higher position.

10. The collapsible awning of claim 7 wherein:

said first arm and said first strut are nested when in the collapsed position; and said second arm and said second strut are nested when in the collapsed position.

11. The collapsible awning of claim 7 wherein the collapsible truss network of the shelter includes: a first side structure including a first truss sliding member slidingly attached to the first leg, and a first X-configured truss structure including an upper end pivotly attached to the upper end of the first leg; and a lower end pivotly attached to the first truss sliding member; and a second side structure including: a second truss sliding member slidingly attached to the second leg, and a second X-configured truss structure including: an upper end pivotly attached to the upper end of the second leg; and a lower end pivotly attached to the second truss sliding member; and wherein:

said first strut slider is below the first truss slider; and said second strut slider is below the second truss slider.

12. The collapsible awning of claim 7 wherein said awning support includes:

a front bar connecting said distal ends of said first and second arms; said front bar having an erect position maintaining said distal ends if said first and second arms at a fixed distance, and a collapsed position.

13. The collapsible awning of claim 7 wherein said awning support includes a pair of truss members connecting said proximal end of each said arm to said distal end of the other said arm.

14. A collapsible shelter including:

a canopy support including:

at least three support legs including:

a first leg having a longitudinal axis and including:

an upper end; and a lower end; and a second leg having a longitudinal axis and including:

an upper end; and a lower end; and side structures joining said legs comprising:

a first side structure including:

a first truss sliding member slidingly attached to said first leg; and a first X-configured truss structure including:

an upper end pivotly attached to said upper end of said first leg; and a lower end pivotly attached to said first truss sliding member; and a second side structure including:

a second truss sliding member slidingly attached to said second leg, and a second X-configured truss structure including:

an upper end pivotly attached to said upper end of said second leg; and a lower end pivotly attached to said second truss sliding member; said canopy collapsible from an erect position, wherein said legs are erect and spaced so as to define a shelter area adapted for supporting a canopy to a collapsed position, wherein said legs are in close proximity;

a canopy supported by said canopy support;

an awning support movable from a collapsed position to an erect position, said awning support including:

a first side support including:

a first arm having a longitudinal axis including:

a proximal end;

a distal end; and a midsection therebetween;

pivot attachment means for pivotly attaching said proximal end to said upper end of said first leg such that said first arm is pivotal from a collapsed position, wherein the longitudinal axis of said first arm parallels the longitudinal axis of said first leg to an erect position, wherein said first arm is pivoted outward from said first leg; and a first strut having a longitudinal axis and including:

a first end pivotly attached to said first leg or said first arm; and a second end including:

first attachment means; said first strut pivotable from a collapsed position, wherein its longitudinal axis is substantially parallel with the longitudinal axis of said leg to an erect position, wherein said attachment means attaches said second end to the other of the first leg or said first arm such that said first strut spans between said first leg and said first arm and supports said first arm in the erect position; and a second side support including:

a second arm having a longitudinal axis including:

a proximal end;

a distal end; and a midsection therebetween;

pivot attachment means for pivotly attaching said proximal end to said upper end of said second leg such that said second arm is pivotal from a collapsed position, wherein the longitudinal axis of said second arm parallels the longitudinal axis of said second leg to an erect position, wherein said second arm is pivoted outward from said second leg; and a second strut having a longitudinal axis and including:

a first end pivotly attached to said second leg or said second arm; and a second end including:

second attachment means; said second strut pivotable from a collapsed position, wherein its longitudinal axis is substantially parallel with the longitudinal axis of said leg to an erect position, wherein said attachment means attaches said second end to the other of said second leg or said second arm such that said second strut spans between said second leg and said second arm and supports said second arm in the erect position; and an awning including:

a first side attached to said first arm; and a second side attached to said second arm.

15. The collapsible shelter of claim 14 wherein:

said first strut first end is pivotly attached to said first arm; and said first attachment means includes:

a first strut slider slidingly and pivotly attaching said second end of said first strut to said first leg and slideable along said first leg from a lower position, wherein said first side support is in a collapsed position, wherein the longitudinal axes of said first arm and said first strut are substantially parallel with the longitudinal axis of said first leg to a higher position, wherein said first side support is in an erect position, wherein first strut supports said first arm pivoted outward from said first leg; and said second strut first end is pivotly attached to said second arm; and said second attachment means includes:

a second strut slider slidingly and pivotly attaching said second end of said second strut to said second leg and slideable along said second leg from a lower position, wherein said second side support is in a collapsed position, wherein the longitudinal axes of said second arm and said second strut are substantially parallel with the longitudinal axis of said second leg to a higher position, wherein said second side is in an erect position, wherein second strut supports said second ant pivoted outward from said second leg.

16. The collapsible shelter of claim 15 wherein:

said first strut slider includes:

retaining means for retaining said first strut slider at the higher position; and said second strut slider includes:

retaining means for retaining said second strut slider at the higher position.

17. The collapsible shelter of claim 14 wherein:

said first arm and said first strut are nested when in the collapsed position; and said second arm and said second strut are nested when in the collapsed position.

18. The collapsible awning of claim 14 wherein said collapsible truss network of said shelter includes: a first side structure including: a first truss sliding member slidingly attached to said first leg, and a first X-configured truss structure including: an upper end pivotly attached to said upper end of said first leg; and a lower end pivotly attached to said first truss sliding member; and a second side structure including: a second truss sliding member slidingly attached to said second leg, and a second X-configured truss structure including: an upper end pivotly attached to said upper end of said second leg; and a lower end pivotly attached to said second truss sliding member; and wherein:

said first strut slider is below said first truss slider; and said second strut slider is below said second truss slider.

19. The collapsible awning of claim 14 wherein said awning support includes:

a front bar connecting said distal ends of said first and second arms; said front bar having an erect position maintaining said distal ends if said first and second arms at a fixed distance, and a collapsed position.

20. The collapsible awning of claim 14 wherein said awning support includes:

a pair of truss members connecting said proximal end of each said arm to said distal end of the other said arm.

* * * * *